US009220969B2

(12) United States Patent
Soldan et al.

(10) Patent No.: US 9,220,969 B2
(45) Date of Patent: Dec. 29, 2015

(54) SKI BINDING

(71) Applicant: SALOMON SAS, Metz-Tessy (FR)

(72) Inventors: Daniel Soldan, Seynod (FR); Nicolas Legrand, Epagny (FR); Alain Berthet, Sainte Héléne sur Isère (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/681,666

(22) Filed: Apr. 8, 2015

(65) Prior Publication Data

US 2015/0290524 A1 Oct. 15, 2015

(30) Foreign Application Priority Data

Apr. 9, 2014 (FR) ..... 14 00866
Apr. 9, 2014 (FR) ..... 14 00867
Apr. 9, 2014 (FR) ..... 14 00868
Apr. 9, 2014 (FR) ..... 14 00870

(51) Int. Cl.
*A63C 9/00* (2012.01)
*A63C 9/20* (2012.01)
*A63C 9/22* (2012.01)

(52) U.S. Cl.
CPC .... *A63C 9/20* (2013.01); *A63C 9/22* (2013.01)

(58) Field of Classification Search
CPC ..... A63C 9/00; A63C 9/001; A63C 9/003; A63C 9/007; A63C 9/084–9/0848; A63C 9/20; A63C 9/22
See application file for complete search history.

(56) References Cited

U.S. PATENT DOCUMENTS 3,744,810 A 7/1973 Jungkind
RE27,991 E * 4/1974 von Besser ..... A63C 9/086 280/618
4,078,828 A * 3/1978 Salomon ..... A63C 9/007 280/625

(Continued)

FOREIGN PATENT DOCUMENTS

EP 0-199-098 A2 10/1986
EP 2 347 807 A1 7/2011

(Continued)

OTHER PUBLICATIONS

U.S. Appl. No. 14/681,646 (Daniel Soldan), entitled "Ski Binding," filed Apr. 8, 2015.

*Primary Examiner* — Jeffrey J Restifo
*Assistant Examiner* — Erez Gurari
(74) *Attorney, Agent, or Firm* — Greenblum & Bernstein, P.L.C.

(57) ABSTRACT

A toe-piece for binding a boot to a gliding board, the toe-piece including a first front boot-retaining device and a second front boot-retaining device. The first front boot-retaining device is designed for ascending a slope and includes boot-fastening mechanisms defining a hinge axis about which the boot pivots when the toe-piece is in an ascent configuration. The second front boot-retaining device is designed for descending a slope and includes two wings each supporting a lateral interface surface designed to come into contact with a front portion of the boot when the toe-piece is in a descent configuration. The toe-piece also includes a longitudinal stop surface movable between an active position in which it is designed to cooperate with the front portion of the boot, and an inactive position in which it is arranged so that it is no longer capable of cooperating with the front portion of the boot. The longitudinal stop surface is movable in relation to the wings.

14 Claims, 10 Drawing Sheets

(56) References Cited

U.S. PATENT DOCUMENTS

| | | | | | |
|---|---|---|---|---|---|
| 4,155,569 | A * | 5/1979 | Salomon | A63C 9/007 | 280/625 |
| 4,478,426 | A * | 10/1984 | Scheck | A63C 9/08521 | 280/625 |
| 4,479,664 | A * | 10/1984 | Gertsch | A63C 7/1013 | 280/605 |
| 4,516,792 | A | 5/1985 | Scheck et al. | | |
| 5,092,620 | A * | 3/1992 | Girault | A63C 9/20 | 280/615 |
| 5,639,108 | A * | 6/1997 | Challande | A43B 1/0054 | 280/607 |
| 5,746,439 | A * | 5/1998 | Boehm | A63C 9/003 | 280/602 |
| 5,803,479 | A * | 9/1998 | Meyer | A63C 5/075 | 280/602 |
| 8,544,869 | B2 | 10/2013 | Lehner | | |
| 2009/0283988 | A1 * | 11/2009 | Holzer | A63C 9/08521 | 280/625 |
| 2011/0298196 | A1 | 12/2011 | Lehner | | |
| 2013/0087992 | A1 | 4/2013 | Ibach et al. | | |
| 2013/0214513 | A1 | 8/2013 | Barthel | | |
| 2013/0285352 | A1 | 10/2013 | Lehner et al. | | |
| 2013/0300089 | A1 * | 11/2013 | Barthel | A63C 9/006 | 280/631 |
| 2013/0328289 | A1 | 12/2013 | Vailli et al. | | |
| 2014/0159345 | A1 | 6/2014 | Indulti | | |

FOREIGN PATENT DOCUMENTS

| | | | |
|---|---|---|---|
| EP | 2 392-388 | A1 | 12/2011 |
| EP | 2 452 731 | A1 | 5/2012 |
| EP | 2 574 379 | A2 | 4/2013 |
| EP | 2 626 116 | A1 | 8/2013 |
| EP | 2 656 885 | A2 | 10/2013 |
| EP | 2 662 121 | A2 | 11/2013 |
| EP | 2 674 203 | A1 | 12/2013 |
| EP | 2 737 930 | A1 | 6/2014 |
| FR | 2 089 540 | A | 1/1972 |
| FR | 2 567 409 | A1 | 1/1986 |

* cited by examiner

SKI BINDING

CROSS-REFERENCE TO RELATED APPLICATION

This application is based upon French Patent Application Nos. FR 14.00866, FR 14.00867, FR 14.00868, and FR 14.00870, all four filed Apr. 9, 2014, the disclosures of which are hereby incorporated by reference thereto, and the priorities of which are hereby claimed under 35 U.S.C. §119.

BACKGROUND

1. Field of the Invention

The present invention relates to a toe-piece for binding a boot on a gliding board adapted for the practice of ski touring.

2. Description of Background

There exist toe-pieces equipped with devices adapted to the practice of ski touring practice, whether in the ascent phase or in the descent phase.

For example, U.S. Pat. No. 8,544,869 discloses a first conventional boot-fastening mechanism dedicated to the ascent. The latter comprises boot-fastening mechanisms defining a hinge axis about which the boot pivots when engaged with this mechanism. During descent phase, this mechanism is reinforced by a second mechanism covering the front portion of the boot. This second mechanism comprises a jaw comprising two wings and a longitudinal support surface. The jaw is movable between an active position, in which it is in contact with the boot, and an inactive position, in which it is no longer in contact with the boot.

In this solution, the wings and the support surface form a single piece. With this integral construction, it is necessary to provide a large clearance at the front of the toe-piece for retracting the jaw to create a space in the area of the first mechanism, in order not to hinder the rotation of the boot during the descent phase. The jaw can retract only forwardly of the toe-piece due to its space requirement. This results in a relatively large toe-piece. Moreover, this construction does not allow relative movement between the wings.

For ski touring, a commonly used toe-piece is described in the document EP-A-0 199 098. This toe-piece comprises a boot-fastening mechanism provided with two points capable of cooperating with an insert positioned on the front portion of the boot sole. Each point is attached to a first arm of a lever articulated about a longitudinal axis and extending substantially upwardly. The two levers are arranged symmetrically with respect to a vertical plane passing through the longitudinal axis of the toe-piece. The second arm of a lever extends toward the other lever and is substantially horizontal. The second arms of the levers are connected to the same central element by springs. When the fastening mechanism is activated, the common central element is lowered, thereby causing the pivoting of the levers so as to bring them closer to the points. The two points are then aligned and cooperate with the boot. The aligned points define a hinge axis of the boot, transverse to the gliding board.

During the ascent phases, it is preferable to block the pivoting of the levers in order to maintain cooperation between the points and the boot. Without this locking, the points may be spaced apart, causing the release of the boot from the toe-piece. Locking mechanisms are described in the documents EP-A-2 347 807 and EP-A-2 452 731. In these examples, the locking mechanism immobilizes an actuating lever acting on the common central element of the levers.

Due to these constructions, the points exert substantial forces on the boot when the latter is engaged with the toe-piece. These forces can cause wear on the boot in the area of the interface, on the one hand, and disturb the rotation of the boot about of the pivot axis, on the other hand. Indeed, the greater the force exerted by the points, the more rubbing/friction is generated during the rotational movement of the boot. It is therefore desirable that less force be exerted by the points on the boot to facilitate the rotation of the boot about a transverse axis.

Moreover, when a lateral force is exerted on the front of the boot, these forces are transmitted by the levers to the central element. The take-up of lateral forces is not direct with the chassis. The levers are substantially constrained, thereby implying adapted dimensioning which tends to weigh down the structure. Furthermore, the immobilization of the levers is obtained via a long driveline. The functional or wear clearances between the elements do not promote good control of the gap dimension of the points.

The ascent phase during ski touring requires a binding of the boot to the ski that is functionally very different from that required in the descent phase. This translates into requirements in terms of safety and retention of the binding and kinematics of the boot, which are variable from one phase to the other. Thus, during the descent, the binding must ensure very good boot retention on the ski, preferably with binding release in the event of a fall in order not to injure the skier. During the ascent, the boot must be capable of rotating about a transverse axis substantially at the front of the boot sole. Therefore, the boot is not immobilized in relation the ski, and there is no need for binding release in the ascent.

A number of bindings have been designed specifically for the descent. Such bindings often comprise a toe-piece incorporating a lateral release mechanism associated with the pivoting of wings adapted to clamp the front of the boot. Such a toe-piece is described in the document FR-A-2 089 540.

With respect to the ascent, the toe-piece described in the above-mentioned document EP-A 0 199 098 refers to the practice of ski touring. This solution includes a boot-fastening mechanism defining a hinge axis about which the front of the boot pivots during the ascent.

Due to the various functional needs during practice of ski touring, certain manufacturers have developed toe-pieces supporting two distinct front boot-retaining devices. Thus, the skier may use a retaining device adapted to each respective ascent or descent phase of ski touring. The document EP-A-2 626 116 illustrates a toe-piece of this type. This solution includes a first front boot-retaining device provided for the descent and comprising two pivotable wings associated with a lateral release mechanism. The wings support interface surfaces adapted to come into contact with the front a boot sole in order to vertically and laterally maintain the front of the boot. This toe-piece also includes two points, each being fixed on a respective extension of a wing, above the interface surfaces. These points constitute elements of a boot-fastening mechanism similar to that described in the document EP-A-0 199 098. In the embodiments described in the document EP-A 2 626 116, the points define a boot hinge axis positioned longitudinally, substantially in the area of the interface surface used as a longitudinal abutment for the boot, when the toe-piece is in the descent configuration. This arrangement reinforces the longitudinal compactness of the toe-piece. To optimize the toe-piece, each point is integral with a wing. Thus, these points are directly biased by the lateral release mechanism. The number of constituent elements is reduced. Although compact lengthwise, this construction causes an upward offset of the boot hinge axis during the ascent phase. Consequently, the front of the boot pivots about an axis of rotation distant from the gliding surface of the ski when the toe-piece is in the ascent configuration. However, to improve the stability of the skier and preserve the equipment during the ascent phases, the axis of rotation of the boot is preferably as close to the gliding surface as possible. The previous construction does not make this possible and imposes a minimum height dimension corresponding to the space requirement of the elements of the first front retaining device.

Furthermore, due to their positioning, the points are relatively exposed/accessible and may catch and/or injure to the user while handling the ski when not in use.

SUMMARY

The invention provides an improved toe-piece.

In particular, the invention provides a compact toe-piece with a reduced space requirement.

The invention also provides a toe-piece enabling a free volume to be created between the wings.

Further, the invention provides a toe-piece comprising wings that are movable with respect to one another.

The invention provides a toe-piece for binding of a boot on a gliding board, the toe-piece comprising a first front boot-retaining device provided for ascending a slope, the device comprising boot-fastening mechanisms defining a hinge axis about which the boot pivots when the toe-piece is in an ascent configuration; a second front boot-retaining device provided for the descent, the device comprising two wings each supporting a lateral interface surface adapted to come into contact with a front portion of the boot when the toe-piece is in a descent configuration; a longitudinal stop surface movable between an active position, in which it is designed to cooperate with the front portion of the boot, and an inactive position, in which it is arranged so that it is no longer capable of cooperating with the front portion of the boot.

The longitudinal stop surface of the toe-piece is movable in relation to the wings.

In addition to the foregoing, the invention provides an improved toe-piece that includes an alternative solution for locking the levers.

The invention also provides a toe-piece enabling the forces of the points on the boot to be reduced when the boot is engaged with the toe-piece.

Moreover, the invention provides a toe-piece enabling a more direct take-up of lateral forces with the chassis.

The invention further provides a toe-piece with reduced size.

The invention provides a toe-piece for binding a boot on a gliding board, the toe-piece comprising a first front boot-retaining device provided for ascending a slope, such a device comprising boot-fastening mechanisms defining a hinge axis about which the boot pivots when the toe-piece is in an ascent configuration, each fastening mechanism being affixed to a carrying arm of a support pivoting about an axis. A second front boot-retaining device is provided for the descent, such second device comprising two wings, each wing supporting a lateral interface surface adapted to come into contact with a front portion the boot when the toe-piece is in a descent configuration.

The toe-piece comprises at least one take-up element designed to cooperate with at least one carrying arm of a support so as to limit the spacing of the fastening mechanisms to a predetermined value.

The take-up element makes it possible to reduce the driveline connecting the fastening mechanisms with the chassis. The force take-up is more direct. The carrying arms are less biased, which makes it possible to optimize their dimensioning, and therefore to lighten the structure. Moreover, the carrying arms can be designed not to require substantial return force. Consequently, this reduces the forces of the points on the boot when the latter is engaged with the toe-piece. This reduction in force makes it possible to reduce the wear on the boot and/or the elements of the toe-piece and to improve the kinematics of the boot during the ascent phases.

In addition to the foregoing, the invention provides a toe-piece that provides stability to the skier during the ascent phases.

In particular, the invention provides a robust toe-piece.

The invention also provides a toe-piece providing safety while handling the ski when not in use.

The invention further provides a height-wise compact toe-piece.

The invention provides a toe-piece for binding a boot on a gliding board, the toe-piece comprising a support surface designed to be in contact with an upper surface of the gliding board; a first front boot-retaining device provided for ascending a slope, such a device comprising boot-fastening mechanisms defining a hinge axis about which the boot pivots when the toe-piece is in an ascent configuration; a second front boot-retaining device provided for the descent. The second device comprises two wings, each wing pivoting about an axis of rotation and supporting a lateral interface surface designed to come into contact with a front portion of the boot when the toe-piece is in a descent configuration, and a vertical interface surface designed to come into contact with an upper surface of the front portion of the boot when the toe-piece is in a descent configuration.

The fastening mechanisms of the toe-piece are arranged in relation to the vertical interface surface so that the distance between the hinge axis and the support surface is less than or equal to the distance between the vertical interface surface and the support surface.

This construction makes it possible to lower the boot hinge axis towards the gliding surface of the gliding apparatus. The skier can thus improve supports, and thereby increase stability, during the ascent phases. Positioning the axis of rotation as close to the gliding apparatus as possible reduces the torsional/flexional stresses exerted on the toe-piece, thereby optimizing its dimensioning. Similarly, the clearances due to wear, inherent in the toe-piece and resulting from repeated lateral biases caused by the movements of the boot, especially when the skier moves on slopes, are reduced. This bias of the toe-piece is greater when the boot/toe-piece interface is away from the gliding surface. With this construction, the stresses exerted on the constituent elements are reduced, thereby improving the strength of the toe-piece. The dimensioning of the toe-piece can be optimized.

Furthermore, this arrangement makes it possible to reduce the height-wise space requirement of the toe-piece.

Lowering the location of the boot-fastening mechanisms also limits their exposure and, therefore, the risk of inadvertently catching them when handling of the gliding apparatus.

According to advantageous but not essential aspects of the invention, such a toe-piece may incorporate one or more of the following characteristics, taken in any technically feasible combination:

- One wing is movable in relation to the other.
- The displacement of the longitudinal stop surface is a translation or a rotation, or a combination of movements.
- The stop surface is affixed to a movable support element.
- The longitudinal stop surface is formed by an element attached to the support element.
- When the longitudinal stop surface is in the inactive position, the support element is positioned in relation to the first front retaining device, such that no portion of the support element interferes with the boot, when the boot pivots about its hinge axis in the ascent configuration.

The support element is rotatably mounted in relation to a frame and positioned in relation to the second front retaining device such that the support element tilts rearwardly of the toe-piece to be housed between and beneath the wings, when the longitudinal stop surface is in the inactive position.

The support element includes an abutment surface designed to come into contact with the frame for positioning the longitudinal stop surface in the active position.

The support element includes an edge designed to partially cover the front portion of the boot.

The support element includes a holding mechanism designed to cooperate with an element of the toe-piece to hold the support element in a stable folded position.

The support element forms an actuator for actuating an adjustment mechanism.

The adjustment mechanism makes it possible to space apart the wings of the second front retaining device.

The longitudinal stop surface is in the active position when the toe-piece is in a descent configuration.

The invention also relates to a gliding apparatus equipped with a toe-piece as described above.

BRIEF DESCRIPTION OF DRAWINGS

Other features and advantages of the invention will become apparent from the following description, provided by way of non-limiting example, with reference to the annexed drawings, in which.

DETAILED DESCRIPTION

Figure 1:
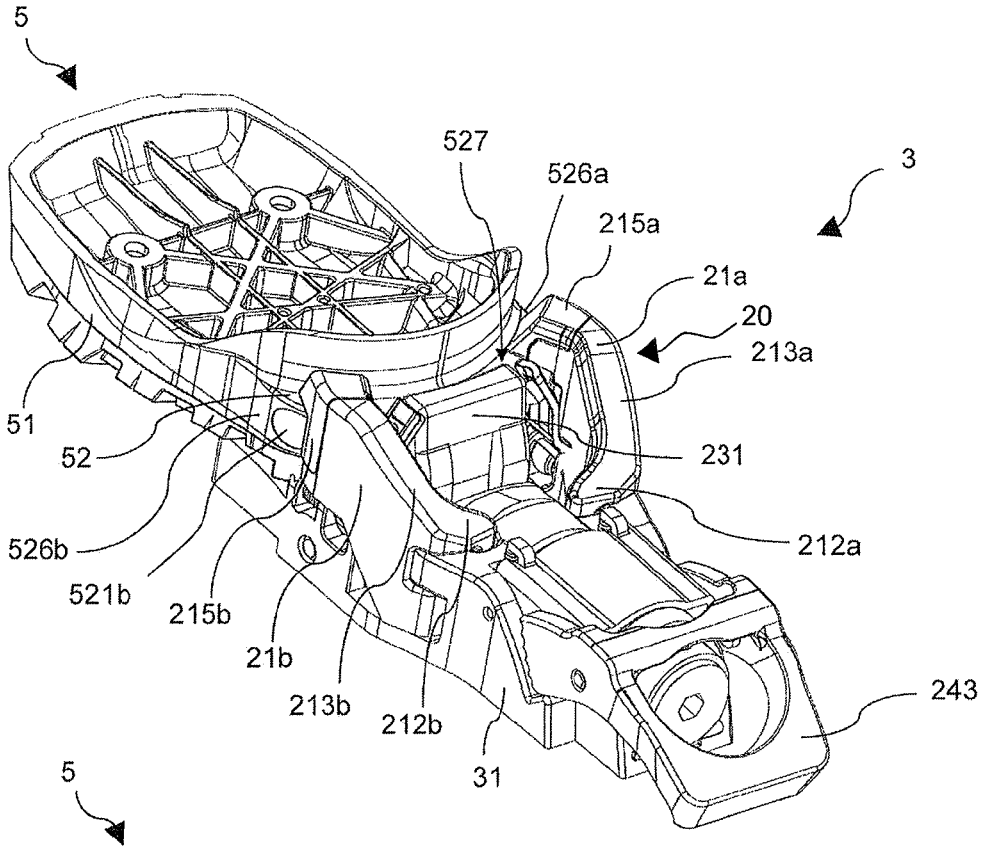
FIG. 1 is a front perspective view of a portion of a boot engaged with a toe-piece according to the invention, the toe-piece being in a first, so-called descent configuration.
Figure 2:
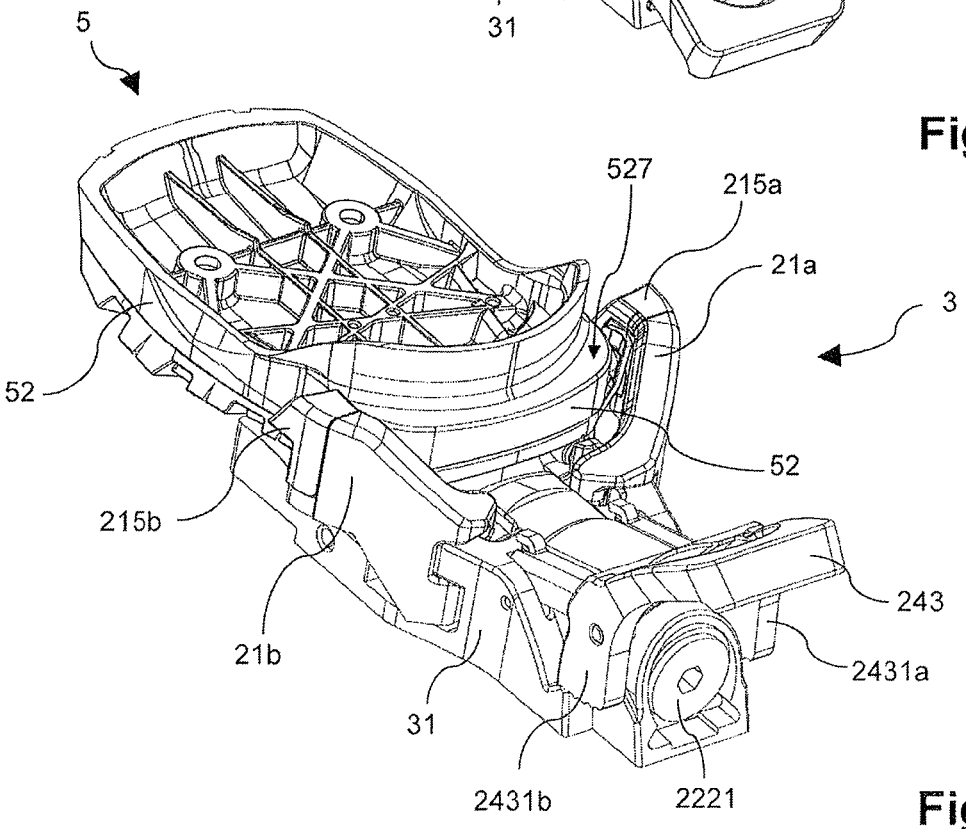
FIG. 2 is a front perspective view of the subassembly of FIG. 1, the toe-piece being in a third, so-called ascent configuration.
Figure 3:
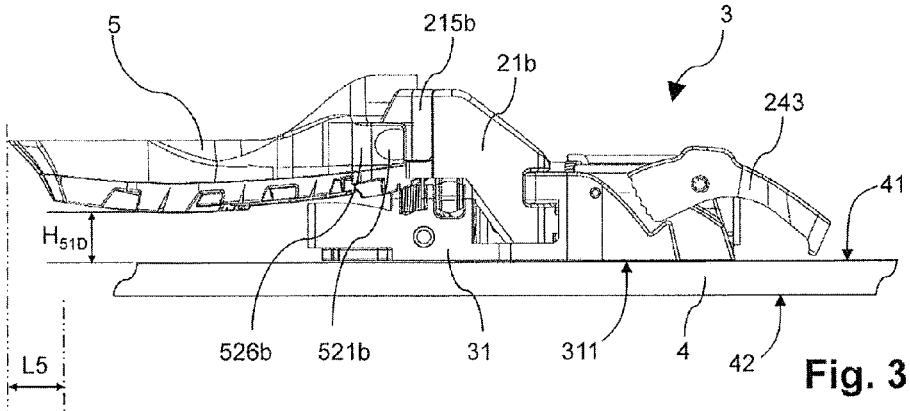
FIG. 3 is a side view of a portion of a boot engaged with a toe-piece attached to a gliding board, the toe-piece being in its first, so-called descent configuration.
Figure 4:
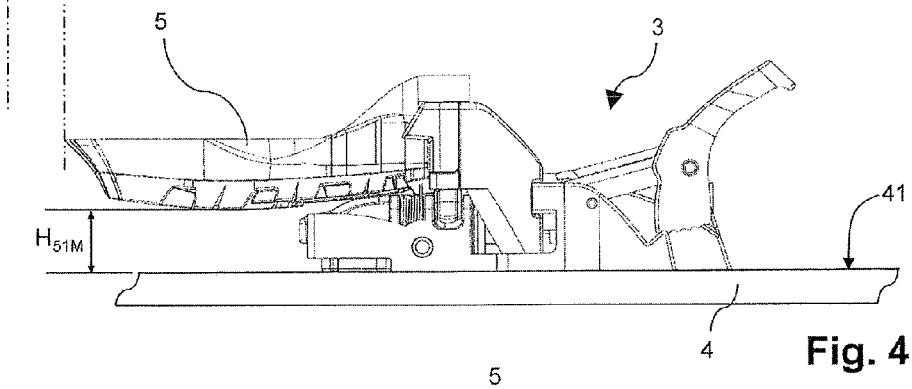
FIG. 4 is a side view of the subassembly of FIG. 3, the toe-piece being in its third, so-called ascent configuration, the boot sole being parallel to the gliding board.
Figure 5:
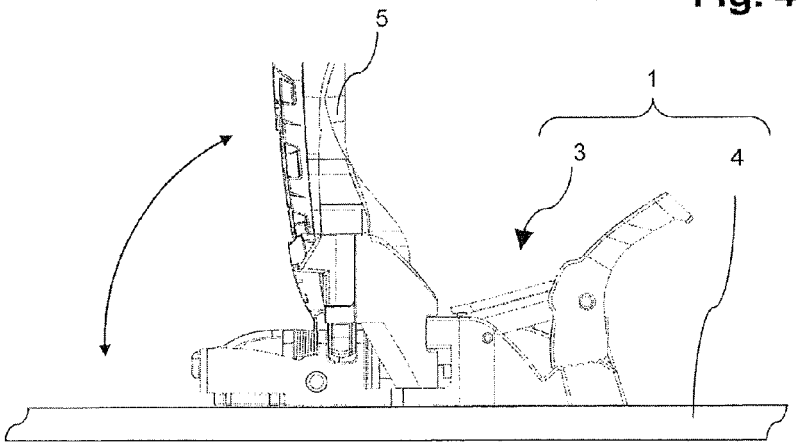
FIG. 5 is a side view of the subassembly of FIG. 4, the boot sole, after pivoting, being perpendicular to the gliding board.
Figure 6:
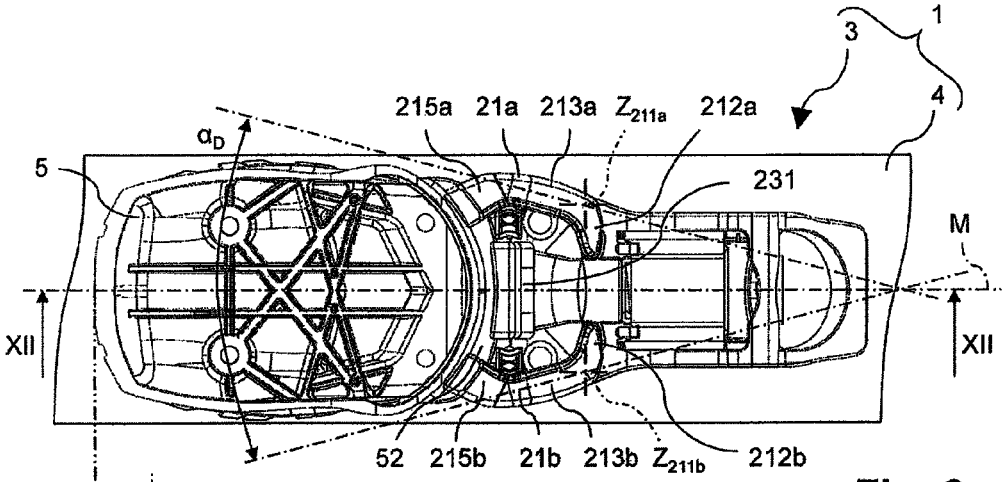
FIG. 6 is a top view of FIG. 3.
Figure 7:
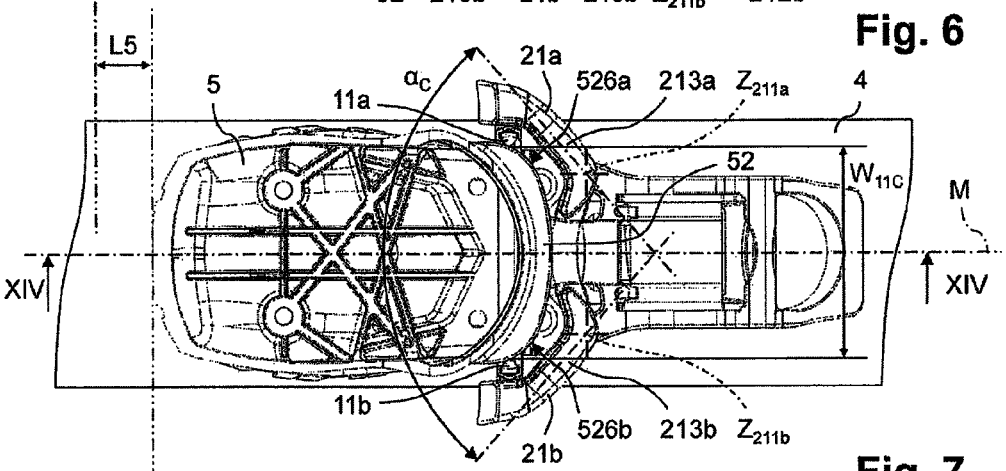
FIG. 7 is a top view of the subassembly of FIG. 6, the toe-piece being in a second, so-called boot-fitting configuration.
Figure 8:
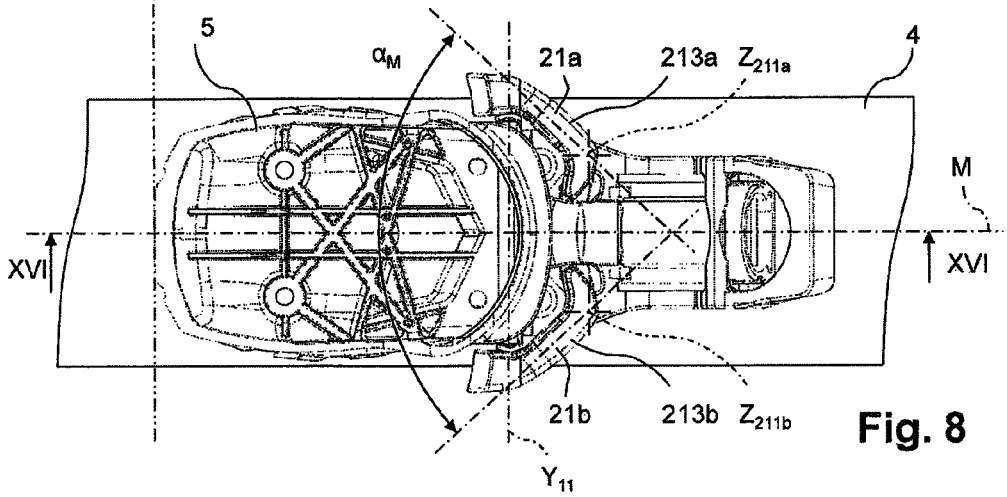
FIG. 8 is a top view of FIG. 4.
Figure 9:
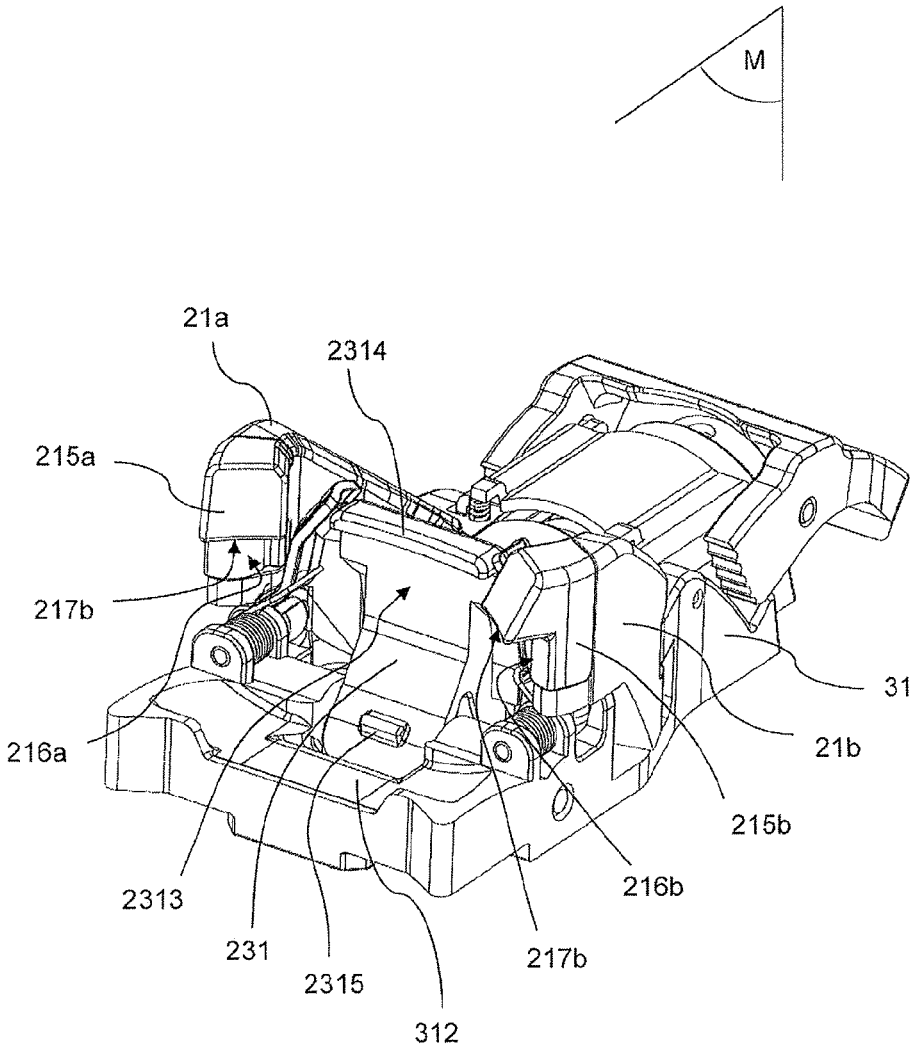
FIG. 9 is a rear perspective view of the toe-piece alone, the toe-piece being in its first, so-called descent configuration.

The invention relates to a binding for binding a boot 5 on a gliding board 4, such as a ski, such binding comprising a rear boot-retaining device, referred to as the "heel-piece", and a front boot-retaining device, referred to as the "toe-piece". The gliding board 4 comprises an upper surface 41 to which the elements of the binding are fixed, and a lower surface 42 or gliding surface, adapted to be in contact with the snow. The association of the boot 5 with the toe-piece and/or heel-piece ensures that the boot is secured to the gliding board. The gliding apparatus 1 means the gliding board 4 equipped with a binding.

The invention relates more specifically to a toe-piece 3 of such a binding.

The following description makes use of terms such as "horizontal", "vertical", "longitudinal", "transverse", "upper", "lower", "top", "bottom", "up", "down", "front", and "rear". These terms should be interpreted as relative terms with respect to the normal position that the toe-piece occupies on a ski, and to the normal advance direction of the ski. For example, the term "longitudinal" means in relation to the longitudinal axis of the ski.

Moreover, in the description, certain directions are qualified in relation to a reference system. In order not to limit the interpretation, the term "substantially" will be used to clarify that the invention also relates to an angular variation of the given direction by more or less 30° with respect to such qualification.

Furthermore, the term "engagement" refers to the coupling of the boot to the binding and the term "release" to the uncoupling of the boot from the binding. More specifically, the "lateral release" refers to release of the binding by a lateral force of the boot on the binding. In the embodiments described below, the lateral release is achieved in the area of the toe-piece, by a lateral displacement of the front of the boot.

The boots 5, adapted to the binding according to the invention, generally comprise a shell provided with two removable end-pieces fixed beneath the shell, a rear end-piece located beneath the heel and a front end-piece located beneath the toes. The sole of the boot is thus formed by the two end-pieces and the lower portion of the shell. To facilitate the understanding and to simplify the drawings, only the front end-piece is shown in certain drawing figures to illustrate the boot. The invention is not limited to a boot of this type and also relates to other boot constructions, such as, for example, boots without removable end-pieces, the sole being formed entirely by the lower portion of the shell.

The toe-piece 3 according to the invention is designed primarily for the practice of ski-touring, although it could also be applied to the practice of alpine skiing only. It includes two front boot-retaining devices which are alternately used depending upon whether ski-touring is in the ascent phase or in the descent phase, that is, whether the skier is ascending a slope with his/her heel free from being restrained in relation to the ski, or whether the skier is descending a slope with both his/her toe and heel are restrained in relation to the ski. A toe-piece for ski touring, therefore, can include a first and a second front retaining device, each designed for a respective phase, that is, the ascent phase and the descent phase.

A first front retaining device 10 of the toe-piece is intended for the ascent phases. It cooperates with a front portion 52 of the sole 51 of a boot 5 so as to enable rotation of the boot about a hinge axis $Y_{11}$ extending transversely in relation to the gliding board, in the area of the front the boot. When the boot 5 is engaged with the first front retaining device 10, it can rotate freely about this axis. For this, the boot heel does not cooperate with a heel-piece.

A second front retaining device 20 of the toe-piece is intended for the descent phases or for the practice of alpine skiing. When the boot 5 is engaged with the second front retaining device 20, the boot is immobilized between the heel-piece and the second front retaining device 20. The boot heel thus cooperates with a heel-piece, as opposed to the previous configuration.

The toe-piece 3 can be adjusted according to three configurations.

A first configuration, the so-called descent configuration, as illustrated in FIGS. 1, 3, 6, 9, 12, 13, corresponds to the adjustment of the toe-piece enabling the cooperation of the boot with the second front retaining device 20.

A second configuration, the so-called boot-fitting configuration, as illustrated in FIGS. 7, 10, 14, 15, corresponds to the adjustment of the toe-piece enabling the release of the boot when engaged with the first front retaining device 10. In this configuration, the boot cooperates with neither of the first front retaining device 10 or second front retaining device 20.

A third configuration, the so-called ascent configuration, as illustrated in FIGS. 2, 4, 5, 8, 11, 16, 17, corresponds to the adjustment of the toe-piece enabling the cooperation of the boot with the first front retaining device 10.

The second front retaining device 20 will now be described in more detail.

In this example, the second front retaining device 20 comprises a frame 31, two wings 21*a*, 21*b*, a lateral release mechanism 22, an adjustment mechanism 23, and a positioning mechanism 24.

The frame 31 includes a lower support surface 311 designed to come into contact with the upper surface 41 of the gliding board 4. It is fixed to the gliding board using conventional fastening expedients, such as screws. The connection between the frame and the gliding board is a flush-fit connection. Alternatively, the frame is slidably mounted on the gliding board, along the longitudinal direction of the gliding board. This translation of the frame enables an adjustment of the longitudinal position of the toe-piece 3. This alternative provides a locking mechanism for immobilizing the frame in relation to the gliding board.

The frame 31 supports two wings 21*a*, 21*b*. Each of the wings pivots about a respective shaft or pin 211*a*, 211*b* affixed to the frame, and extending along an axis of rotation $Z_{211a}$, $Z_{211b}$ substantially vertical, that is to say, perpendicular to the support surface 311. The axes of rotation $Z_{211a}$, $Z_{211b}$ are longitudinally positioned in the same area, on both sides of a median longitudinal axis $X_3$ of the toe-piece. In this example, the axes of rotation $Z_{211a}$, $Z_{211b}$ are distinct.

Each wing 21*a*, 21*b* comprises a first arm, 212*a*, 212*b*, and a second arm 213*a*, 213*b*. The two arms are connected in the area of the axis of rotation $Z_{211a}$, $Z_{211b}$ and form an angle between 60° and 120°. The two wings are symmetrically arranged with respect to a median plane M of the toe-piece, that is to say, the vertical plane including the median longitudinal axis $X_3$ of the toe-piece. When the second front retaining device 20 is engaged with the boot, the first arm 212*a*, 212*b* of a wing extends in the direction of the other wing, slightly forwardly of the toe-piece, and the second arm 213*a*, 213*b* extends rearwardly of the toe-piece, substantially along a longitudinal direction.

The free end of the first arm 212*a*, 212*b* supports a connecting pin 214*a*, 214*b* extending along a substantially vertical direction, and therefore substantially parallel to the axes of rotation $Z_{211a}$, $Z_{211b}$.

The free end of the second arm 213*a*, 213*b* supports surfaces interfacing with a front portion 52 of the sole 51 of the boot 5, when the second front retaining device 20 is engaged with the boot. These interface surfaces comprise a lateral interface surface 216*a*, 216*b* designed to come into contact with a lateral surface 526*a*, 526*b* of the front portion 52 of the boot, and a vertical interface surface 217*a*, 217*b* designed to come into contact with an upper surface 527 of the front portion 52.

In this example, the lateral interface surface 216*a*, 216*b* is formed by pads 215*a*, 215*b* attached to the free end of the second arm 213*a*, 213*b*. These pads also form the vertical interface surface 217*a*, 217*b*. They can be made of a material facilitating the sliding with the boot, such as polyoxymethylene (POM), for example. By being attached to the wings, the pads are interchangeable, thereby facilitating maintenance in the event of wear. Alternatively, the lateral interface surface 216*a*, 216*b* is formed by the outer cylinder of a roller pivotable about a shaft fixed to the free end of the second arm 213*a*, 213*b* and extending along a substantially vertical direction. In this case, the vertical interface surface 217*a*, 217*b* can be defined by interchangeable pads.

Thereafter, an opening angle α of the wings 21*a*, 21*b* corresponds to the angle formed by the two second arms 213*a*, 213*b*. For example, the central axis of the second arms can be considered to express this opening angle α. The smaller the opening angle, the closer together are the free ends of the second arms. Consequently, when the opening angle is reduced, the pads 215*a*, 215*b* come into contact with the front portion 52 of the boot. The boot is then engaged with the second front retaining device 20. Conversely, when the opening angle is increased, the boot is released from the second front retaining device 20.

To maintain contact between the wings and the boot, the second front retaining device 20 comprises a lateral release mechanism 22 cooperating with the wings 21*a*, 21*b*. The release mechanism 22 is housed within the frame 31. It includes a body 223 movable in relation to the frame 31 along a direction substantially longitudinal to the toe-piece, between at least two stable positions. The translation of the body within the frame is carried out by a slide-connection. The body 223 comprises a cylinder 2231 open at a front end and sealed at the rear end by a wall 2232 having an opening 2233. When the body 223 is positioned in the toe-piece, its front end is located at the front of the toe-piece and its rear end is positioned in front of the wings 21*a*, 21*b*. A first elastic member 221 is housed within the cylinder 2231. In this example, it is a compression spring. A second end 2212 of the spring 221 is in contact with the wall 2232 of the body 223. A first end 2211 of the spring 221 is in contact with a nut 2221. This nut 2221 is engaged with a threaded rod 2223 constituting the extension of a member 2222. In this embodiment, a portion of the nut extends within the spring 221, just as a portion of the body 2222. This arrangement makes it possible to reduce the space requirement of the mechanism. The member 2222 extends through the opening 2233 and thus comprises a rear portion, located outside of the cylinder 2231, on the other side of the wall 2232, on the side of the wings 21*a*, 21*b*. The member 2222 is affixed to each free end of the first arms 212*a*, 212*b* due to the connecting pins 214*a*, 214*b*. Indeed, the member 2222 forms, in its rear portion, a horizontal plate extending transversely and pierced laterally on each side by an oblong hole in the transverse direction. A connecting pin 214*a*, 214*b* extends in each oblong hole. The member 2222 with its extension 2223 and the nut 2221 forms a connecting member 222 connecting the wings 21*a*, 21*b* with the first elastic member 221.

The operation of the release mechanism 22 will now be explained.

In a first configuration, the body 223 is positioned in a first stable longitudinal position determined in relation to the frame 31. The spring 221 is compressed and exerts a force on the nut 2221, causing it to move forwardly of the toe-piece. Consequently, the connecting element 222 also moves forwardly, causing the forward displacement of the connecting pins 214*a*, 214*b* and therefore of each free end of the first arms 212*a*, 212*b*. This results in a rotation of the wings 21*a*, 21*b* which tends to bring the free ends of the second arms 213*a*, 213*b* closer together until the lateral interface surfaces 216*a*, 216*b* come in contact with the lateral surfaces 526*a*, 526*b*, respectively, of the front portion 52 of the boot. The second front retaining device 20 is thus engaged with the boot. The wings are in contact with the front portion of the boot to keep it affixed to the gliding board. In this case, the first elastic member biases the displacement of the connecting element toward a position causing the lateral interface surfaces to come closer to the boot. In this configuration, the wings form an opening angle $\alpha_D$.

This first configuration of the release mechanism 22 corresponds to the adjustment of the first configuration of the toe-piece. It is illustrated in FIGS. 1, 3, 6, 9, 12, 13.

In this first configuration, if a lateral force is exerted on the front of the boot, this force is transmitted to a wing 21*a*, 21*b* via the lateral interface surface 216*a*, 216*b*. This force causes the rotation of the wing 21*a*, 21*b*, causing the displacement of the connecting element 222 rearwardly of the toe-piece. This movement then causes compression of the spring 221 via the nut 2221, because the body 223 is held in its first stable longitudinal position determined in relation to the frame 31. As a result, the rotation of the wing is directly dependent upon the compression of the spring. In other words, the force required to obtain the rotation of the wing by a predetermined angle corresponds to the force required to compress the spring by a predetermined stroke. To release the boot laterally from the second front retaining device 20, the wing must rotate by a threshold angle for which the supported lateral interface surface 216*a*, 216*b* is no longer in contact with the corresponding lateral surface 526*a*, 526*b* of the front portion 52 of the boot. To this threshold angle corresponds a predetermined compression force of the spring defining the lateral release threshold value of the second front retaining device 20. A wing is in a release configuration when the lateral interface surface associated with the wing no longer interacts with the corresponding lateral portion of the boot.

This threshold value is adjustable by acting on the nut 2221. Indeed, when rotating, this nut moves in relation to the member 2222, which has the effect of adjusting the prestressing value of the spring 221. It follows that the threshold force for obtaining a rotation of a wing by the threshold angle is no longer the same. The release value of the second front retaining device 20 has therefore been modified and adjusted.

As indicated above, this construction enables the displacement of the body 223 in relation to the frame 31 in various longitudinal stable positions. For this, the second front retaining device 20 includes an adjustment mechanism 23 for adjusting the relative positioning between the body 223 and the frame 31.

In this example, the adjustment mechanism 23 comprises an actuator 231 pivotable about a shaft 232 supported by the frame 31 of the toe-piece and extending transversely, in the vicinity of the lower support surface 311. The shaft 232 is located at the rear of the toe-piece, substantially beneath the interface surfaces of the wings. The actuator 231 includes a cam 2311 close to the shaft 232 and designed to cooperate with a free end of a rear longitudinal extension 2234 of the body 223. This longitudinal extension 2234 extends rearwardly of the toe-piece, from the wall 2232 of the body 223 and passes beneath the wings 21*a*, 21*b*. The actuator 231 also includes a lug or extension 2312 extending substantially in a plane parallel to a plane passing through the axis $Y_{232}$ of the shaft 232.

In order for the rear longitudinal extension 2234 of the body 223 to remain in contact with the cam 2311, the toe-piece 3 comprises a second elastic member 14*a*, 14*b* for moving the body 223 rearwardly of the toe-piece when the body is not biased. In this example, the second elastic member does not act directly on the body, as explained below. Alternatively, the second elastic member can act on an element belonging to the kinematics between the wings 21*a*, 21*b* and the longitudinal extension 2234. For example, this can be a spring acting directly on the body 223.

In this embodiment, the adjustment mechanism 23 provides two stable configurations.

In the first configuration, illustrated in FIGS. 1, 3, 6, 9, 12, 13, the actuator 231 is deployed. It is thus oriented such that the lug 2312 extends substantially vertically upwardly of the toe-piece, and the cam 2311 cooperates with the rear longitudinal extension 2234 of the body 223 in order to position the body 31 forwardly of the toe-piece, in the predetermined first stable longitudinal position defined above. This first configuration corresponds to the first configuration of the so-called descent toe-piece.

In the second configuration shown in FIGS. 7, 10, 14, 15, 2, 4, 5, 8, 11, 16, 17, the actuator 231 is folded or pivoted downward. It is thus oriented such that the lug 2312 extends substantially horizontally rearwardly of the toe-piece and the cam 2311 cooperates with the rear longitudinal extension 2234 of the body 223 in order to position the body rearwardly of the toe-piece, in a predetermined second stable longitudinal position. This second configuration of the adjustment mechanism 23 is that used in two configurations of the toe-piece, the second configuration, so-called boot-fitting configuration, shown in FIGS. 7, 10, 14, 15, and the third configuration, so-called ascent configuration, illustrated in FIGS. 2, 4, 5, 8, 11, 16, 17. In the second configuration of the adjustment mechanism 23, the lug 2312 is housed in an arrangement 312, or seat, provided at the rear of the frame. Thus, the actuator 231 retracts at least partially in the frame 31, which makes the toe-piece compact. The boot may then be positioned longitudinally forwardly of the toe-piece by remaining relatively close to the upper surface 41 of the gliding board 4, without being hindered by the actuator 231. In this configuration, the front 52 of the sole is positioned above the actuator 231. Advantageously, the actuator 231 is dimensioned such that, in this configuration, an upper portion of the actuator serves to support the boot in order to position it vertically to facilitate engagement of the boot with the first front retaining device 10.

When the adjustment mechanism 23 is in its first configuration, the body 223 is pushed forwardly of the toe-piece, which has the effect of bringing the free ends of the second arms 213*a*, 213*b* closer to one another. This bringing together is such that the lateral interface surfaces 216*a*, 216*b* are positioned so as to be capable of cooperating with the front portion 52 of the boot. Thus, the front of the boot is held by the second front retaining device 20 when the boot is inserted in the binding. In this configuration, the boot can be released as soon as a predetermined lateral force is exerted on the front of the boot due to the lateral release mechanism 22, as described above.

According to the illustrated embodiment, the lug 2312 of the actuator 231 includes a longitudinal stop surface 2313 arranged such that, when the adjustment mechanism 23 is in its first configuration, the longitudinal stop surface 2313 is substantially vertical and oriented rearwardly of the toe-piece so as to face the front portion 52 of the boot. Thus, this longitudinal stop surface 2313 serves to longitudinally wedge the boot, which is necessary for proper functioning of the lateral release mechanism 22.

In an alternative embodiment, the longitudinal stop surface 2313 is formed by an element attached to the actuator 231. This facilitates maintenance in the event of damage. This also makes it possible to adjust the longitudinal position of the boot as a function of the sole size/length or of the wear of the sole.

This construction optimizes the toe-piece because the actuator 231 performs a double function, that is, it makes it possible to activate the adjustment mechanism 23 and to position the boot longitudinally in the descent configuration.

In this embodiment, the longitudinal stop surface 2313 is attached to the actuator 231 of the adjustment mechanism 23. Alternatively, it can be affixed to another support element, independent of the adjustment mechanism. In this example, the longitudinal stop surface 2313 is movable with respect to the wings 21*a*, 21*b*. It can move between an active position, in which it is designed to cooperate with the front portion of the boot, and an inactive position, in which it is arranged so as to no longer be capable of cooperating with the front portion of the boot. This construction makes it possible to create a space between the wings when the longitudinal stop surface is in the inactive position. This space can be useful in avoiding any interference of the boot with the toe-piece, if the boot is caused to move; for example, if the boot pivots about a transverse axis. Thus, when the longitudinal stop surface is in the inactive position, the support element, or actuator, is positioned in relation to the first front retaining device so that no portion of the support element interferes with the boot when the latter pivots about its hinge axis, in the ascent configuration.

In the example shown, the support element retracts into the frame as described above. The support element is rotatably mounted in relation to the frame and positioned in relation to the second front retaining device such that the support element tilts rearwardly of the toe-piece to be housed between the wings, thereunder, when the longitudinal stop surface is in the inactive position.

The displacement of the longitudinal stop surface can be a translation or a rotation, or a combination of movement.

Alternatively, the lug 2312 also includes a flange or edge 2314 configured to partially cover the front portion 52 of the boot when the adjustment mechanism 23 is in its first configuration. Thus, this edge 2314 can form a vertical interface surface for the boot. This central vertical interface surface can complete the vertical retention of the boot provided by the vertical interface surfaces 217*a*, 217*b* of the pads mounted on the wings. This makes it possible to reinforce the vertical retention of the front of the boot. Alternatively, this central vertical interface surface can allow for the removal of the vertical interface surfaces of the pads mounted on the wings, the latter then only supporting the lateral interface surfaces. By removing the vertical interface surfaces connected to the wings, undesirable friction forces which can disrupt the rotation of the wings, and therefore the lateral release mechanism 22, are eliminated. In this latter case, there may be only one vertical interface surface formed by the edge 2314. The vertical interface surfaces 217*a*, 217*b* are therefore not necessarily supported by the wings 21*a*, 21*b*.

In the example described, the actuator 231 includes an abutment surface 2316 arranged such that, when the adjustment mechanism 23 is in its first configuration, the abutment surface 2316 is substantially vertical and oriented forwardly of the toe-piece. This abutment surface 2316 is designed to come into contact with a portion of the frame 31 to wedge the actuator 231 in a stable deployed position corresponding to the first configuration, that is, the descent configuration.

When the adjustment mechanism 23 is in its second configuration, the body 223 is moved rearwardly of the toe-piece, which has the effect of spacing the free ends of the second arms 213*a*, 213*b* from one another. This spacing is such that the lateral interface surfaces 216*a*, 216*b* are positioned such that they are no longer capable of cooperating continuously with the front portion 52 of the boot. Thus, the front of the boot cannot be maintained, at least laterally, by the second front retaining device 20, due to the angular orientation of the wings. The boot is released from the second front retaining device 20. This can be useful if the skier wishes to release the binding in the event the ski is immobilized in the snow.

In the example described, the actuator 231 includes a tab 2315 designed to cooperate with the frame 31 to hold the actuator 231 in the stable folded position. This locking is obtained following a slight deformation of the tab 2315 or of a portion of the frame 31. Alternatively, it is possible to provide other holding expedients for holding the actuator 231 in the stable folded position. The tab may be replaced, for example, by a clip. Similarly, the holder can cooperate with an element of the toe-piece other than the frame.

Thus, the manipulation of the actuator 231 by the user makes it possible to switch the toe-piece alternately, from its first configuration, suitable for the descent, as illustrated in FIGS. 1, 3, 6, 9, 12, 13, to its second or third configuration, suitable for boot-fitting or the ascent, shown in FIGS. 7, 10, 14, 15, 2, 4, 5, 8, 11, 16, 17, as is described below. The displacement of the actuator from a stable deployed position, corresponding to the first configuration of the adjustment mechanism, to a stable folded position, corresponding to the second configuration of the adjustment mechanism, or vice versa, causes the displacement of the body 223 in relation to the frame 31. This displacement modifies the characteristics of the lateral release mechanism 22. Indeed, the lateral force to be exerted on the wings in order to obtain a predetermined opening angle $\alpha$ of the wings differs from one configuration to another.

The actuation of the adjustment mechanism 23 has the advantage of obtaining various wing openings without the wings being constrained by the release mechanism 22.

According to the embodiment described, when the actuator 231 is in the deployed position and the boot is engaged with the second front retaining device 20, the boot prevents the rotation of the actuator 231 towards its folded position. This construction therefore enables the actuator 231 to be locked by the boot, when the latter is engaged with the binding. The binding is then secured because the body 223 remains in a stable position, thereby enabling the characteristics of the lateral release mechanism 22 to be preserved.

The same is true in the ascent configuration, that is, the boot prevents the rotation of the actuator 231 toward its fully deployed position.

Thus, when the boot is engaged with the first or second front retaining device, the boot limits the displacement of the actuator 231. This makes it possible to prevent the modification of the characteristics of the lateral release mechanism 22 when the toe-piece is configured for use in the ascent phase or in the descent phase.

In an alternative solution, the actuator causing the displacement of the body 223 is designed and arranged differently. For example, the actuator is positioned forwardly of the toe-piece and movable by a deliberate action of the skier, separate from the movement of the boot, while the boot is engaged with the second front retaining device 20. This solution makes it possible to modify the characteristics of the lateral release mechanism 22 while the shoe is engaged with the second front retaining device 20. This may be useful to release the boot when the ski is immobilized in the snow.

In the illustrated embodiment, the second front retaining device 20 comprises a positioning mechanism 24 for adjusting the opening angle α of the wings. This positioning mechanism 24 is provided to be used when the adjustment mechanism 23 is in its second configuration.

The positioning mechanism 24 includes a shuttle 241, a rocker 242, and a lever 243.

The shuttle 241 is movable longitudinally in relation to the frame 31 and forms a U-shaped folded plate. The central wall 2411 of the plate is positioned beneath the body 223, and the two lateral portions 2412*a*, 2412*b* of the plate extend upwardly, on both sides of the body 223. The central wall 2411 includes two lugs 2413*a*, 2413*b* extending rearwardly of the toe-piece. Each end of the lugs 2413*a*, 2413*b* comprises a hole in which a respective connecting pin 214*a*, 214*b* extends. Thus, the translation of the shuttle causes the translation of the pins, which causes the rotation of the wings 21*a*, 21*b* about their axes of rotation $Z_{211a}$, $Z_{211b}$. If the shuttle moves forwardly of the toe-piece, the opening angle α of the wings, that is to say, the angle between the second arms 213*a*, 213*b*, decreases. Conversely, the displacement of the shuttle rearwardly of the toe-piece increases the opening angle α of the wings. The displacement of the shuttle does not cause the displacement of the body 223. The positioning mechanism 24 is separate from the adjustment mechanism 23. They operate independently of one another.

The rocker 242 is pivotally mounted about a first pivot shaft 244 supported by the frame 31 of the toe-piece and extending transversely. The rocker 242 forms an inverted U-shaped bent plate extending longitudinally. The central wall 2421 of the plate covers an upper portion of the body 223 and the lateral walls 2422*a*, 2422*b* of the plate extend vertically downward, on both sides of the body. The first pivot shaft 244 extends through the two lateral walls 2422*a*, 2422*b* in the vicinity of the central wall and the rear longitudinal end of the plate. Each lateral wall includes an extension 2423*a*, 2423*b* extending vertically downwardly beneath the first pivot shaft 244 in the area of the rear longitudinal end of the plate. The rocker 242 and shuttle 241 are arranged so that each extension 2423*a*, 2423*b* can cooperate with the lateral portions 2412*a*, 2412*b* of the shuttle 241, so that the rotation of the rocker 242 causes the translation of the shuttle 241. In other words, with this construction, lifting the front longitudinal end of the rocker 242 causes the forward displacement of the shuttle 241, which has the effect of closing the wings 21*a*, 21*b* in the direction of the boot. Conversely, lowering the front longitudinal end of the rocker 242 causes the rearward displacement of the shuttle 241, which has the effect of opening the wings 21*a*, 21*b* by spacing them from the boot.

Thus, the opening angle α of the wings 21*a*, 21*b* is directly dependent on the angular position of the rocker 242. As a result, a predetermined opening angle α of the wings 21*a*, 21*b* corresponds to a predetermined angular position of the rocker.

An elastic member 245 is interposed between the rocker 242 and the frame 31, so as to rotate the rocker until it abuts against the frame. This stable rest configuration corresponds to a lowering of the front longitudinal end of the rocker 242, and therefore to a wide opening of the wings 21*a*, 21*b*.

To modify the opening angle α of the wings, the positioning mechanism 24 includes a lever 243 pivotally mounted about a second pivot shaft 246 supported by the rocker 242. The second pivot shaft 246 extends transversely through the two lateral walls 2422*a*, 2422*b* of the rocker 242, in the vicinity of the center wall 2421 and front longitudinal end of the plate. The lever 243 forms a fork, the arms 2431*a*, 2431*b* of which extend on both sides of the rocker 242. Each arm 2431*a*, 2431*b* is crossed in its center by the second pivot shaft 246. Each free end of the arms 2431*a*, 2431*b* of the fork is configured to cooperate with a portion of the frame 31 when the lever is in a predetermined locking position. The lever 243 is dimensioned such that when its free ends cooperate with the frame, the front longitudinal end of the rocker 241 is displaced upwardly and, therefore, the rocker is rotated by a predetermined angle. Consequently, the wings 21*a*, 21*b* are closed in the direction of the boot, as explained above. The lever 243 takes a configuration for which it does not cooperate with the frame. In this case, the rocker rotates about the pivot shaft 242, due to the elastic member 245, to return to the stable rest configuration described above.

The lever 243 can include a return mechanism such as a torsion spring, for example, to bring it back into a position in which it does not cooperate with the frame.

In the embodiment described, the free ends of the arms 2431*a*, 2431*b* of the lever 243 each include a serration, each serration groove being designed to cooperate with a complementary shape provided on the frame. The serration is designed such that for each cooperation between a serration groove and the complementary shape corresponds to a specific upward movement of the front longitudinal end of the rocker 241 and, therefore, the rotation of the rocker by a predetermined angle. This design therefore makes it possible to obtain a finer angular adjustment of the opening of the wings 21*a*, 21*b* with a plurality of predetermined opening angle α values.

To obtain a desired opening angle α of the wings 21*a*, 21*b*, it suffices to operate the lever 243 to bring it in a predetermined configuration. This construction has an additional particularity. The cooperation between each extension 2423*a*, 2423*b* of the rocker 242 with the lateral portions 2412*a*, 2412*b* of the shuttle 241 results in locking the opening of the wings. Thus, for a given configuration, the wings 21*a*, 21*b* can be closed by acting on their backs, but they cannot be further opened. This specific characteristic cancels the lateral release mechanism 22.

However, when the adjustment mechanism 23 is in its first configuration, i.e., the descent configuration, the shuttle 241 is moved forward, which has the effect of eliminating the cooperation between each extension 2423*a*, 2423*b* of the rocker 242 with the lateral portions 2412*a*, 2412*b* of the shuttle 241. This elimination of interaction between the rocker and the shuttle deactivates the positioning mechanism 24 in the descent mode. This makes it possible to secure the operation of the release mechanism against an involuntary action on the lever 243. Without this deactivation, an action on the lever would cause the opening or locking of the wings via the positioning mechanism 24. Thus, in this case, locking the opening of the wings is no longer possible. The wings can be opened by a lateral force. The lateral release mechanism 22 is then functional.

The first front retaining device 10 will now be described in more detail.

In this example, the first front retaining device 10 includes two supports 12*a*, 12*b*, each being pivotally mounted about an axis $X_{13a}$, $X_{13b}$ of a shaft 13*a*, 13*b*, respectively, supported by the frame 31 of the toe-piece and extending longitudinally on both sides of the median longitudinal axis $X_3$ of the toe-piece. Each support 12*a*, 12*b* comprises a carrying arm 121*a*, 121*b* hinged at a first end about the axis $X_{13a}$, $X_{13b}$, the second end being free. A fastening mechanism 11*a*, 11*b* is affixed to the inner portion of the second end of the support arm 121*a*, 121*b*, that is to say, the portion oriented toward the median plane M of the toe-piece. The fastening mechanism can be an attached element, which facilitates its replacement in the case of wear, or it can be integral with the carrying arm, which reduces the number of components and makes the toe-piece more economical. In this latter case, the fastening mechanism and the carrying arm form a single element. The two fastening mechanisms 11*a*, 11*b* are designed to cooperate with the front portion 52 of the boot 5 so as to define a hinge axis $Y_{11}$, substantially transverse to the toe-piece, about which the boot is pivotable. In this example, each fastening mechanism 11*a*, 11*b* is in the form of a point, an end portion of which is housed in a recess 521*a*, 521*b*, respectively, positioned on a lateral side of the front portion 52 of the boot, when the first front retaining device 10 is in the ascent configuration. By construction, the points are opposite one another. The points are aligned to form the hinge axis $Y_{11}$ when the first front retaining device 10 is in the ascent configuration. An elastic member 14*a*, 14*b* is associated with each support 12*a*, 12*b*. The elastic members 14*a*, 14*b* act on the corresponding carrying arm 121*a*, 121*b* to cause it to rotate so that the second end moves away from the median plane M of the toe-piece. In this example, the elastic member is a torsion spring comprising one end affixed to the frame 31 and the other end in support on a central inner portion of the bearing arm 121*a*, 121*b*.

In this embodiment, the carrying arms 121*a*, 121*b* are arranged longitudinally between the second arms 213*a*, 213*b* of the wings 21*a*, 21*b*. This arrangement is such that each wing 21*a*, 21*b* limits the rotation of a corresponding carrying arm 121*a*, 121*b*. Thus, the outer portion of each support is designed to be in contact with an inner portion of a second arm 213*a*, 213*b*. This contact is continuous due to the elastic members 14*a*, 14*b*.

With this construction, each elastic member 14*a*, 14*b* exerts a force on the associated carrying arm 121*a*, 121*b*, which tends to space the second ends, and therefore the fastening mechanisms 11*a*, 11*b* apart from one another. This force is transmitted to the wings through contact of the carrying arms with the second arms. Consequently, the elastic members bias the wings so as to open them. The more the wings are closed, the more substantial is the bias.

In the embodiment described, these elastic members 14*a*, 14*b* correspond to the second elastic member for moving the body 223 rearwardly of the toe-piece when the body is not biased.

Furthermore, if the opening angle $\alpha$ of the wings 21*a*, 21*b* is limited via the positioning mechanism 24, as described previously, the rotation of the supports 12*a*, 12*b* is blocked. The maximum spacing between the fastening mechanisms 11*a*, 11*b* is then controlled.

The first front retaining device 10 can be adjusted according to two configurations, namely, an ascent configuration and a boot-fitting configuration.

Figure 11:
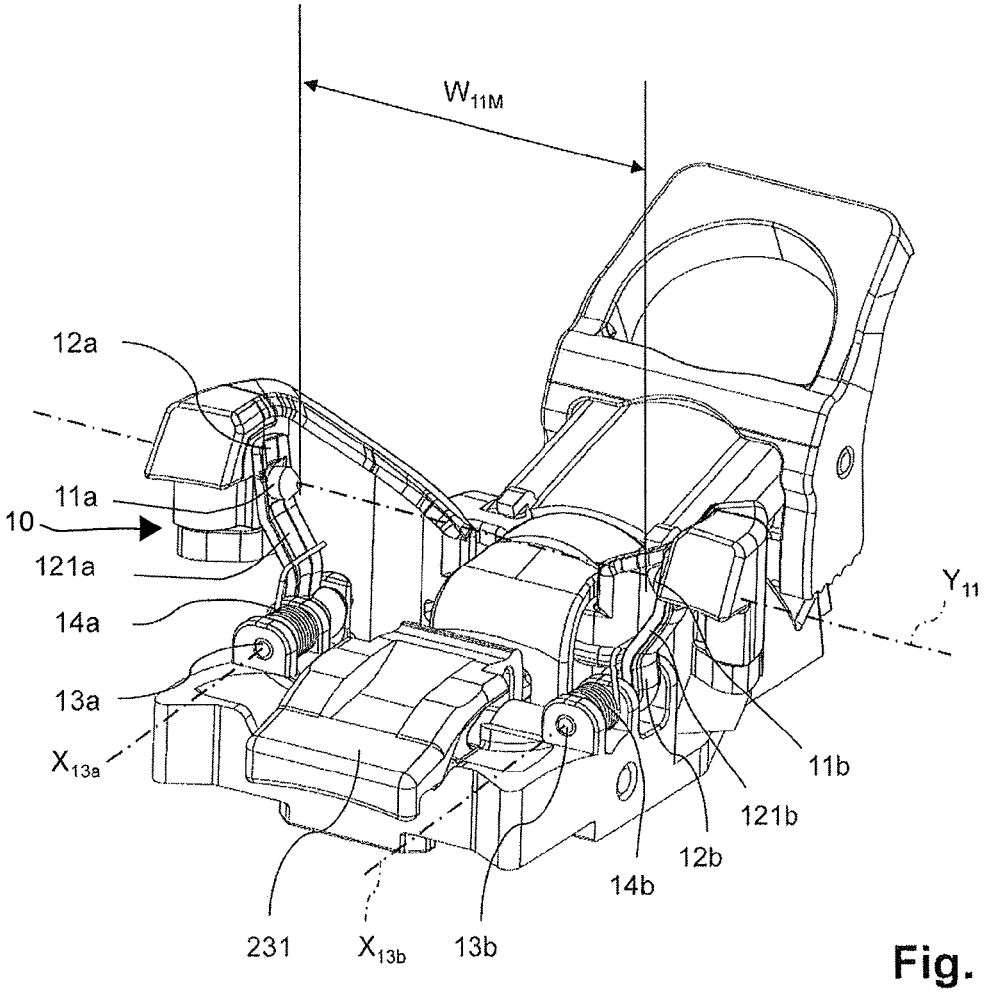
FIG. 11 is a rear perspective view of the toe-piece alone, the toe-piece being in its third, so-called ascent configuration.
Figure 12:
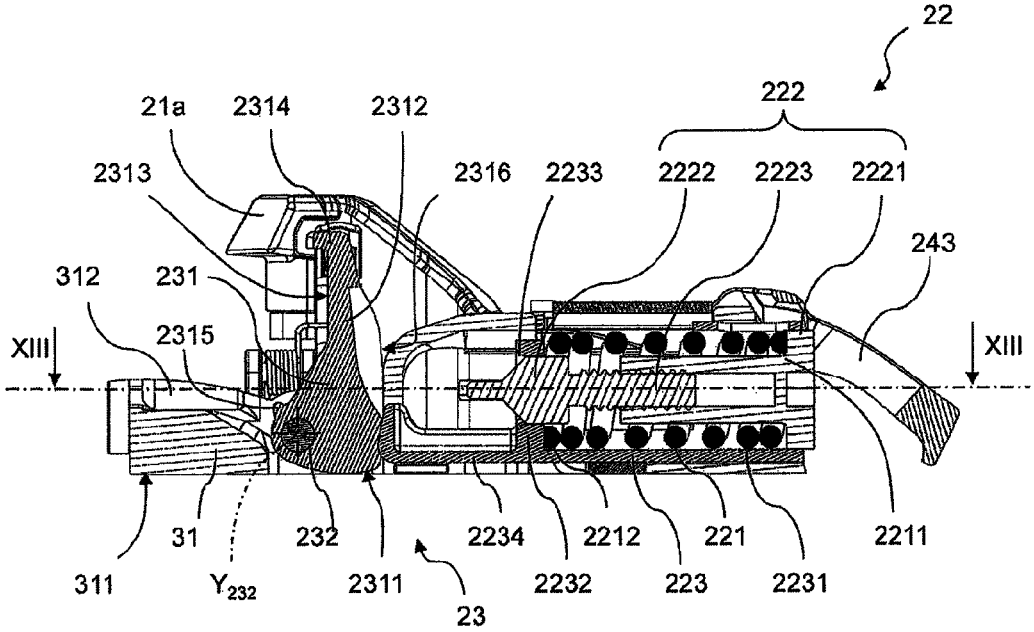
FIG. 12 is a cross-sectional view of the toe-piece alone, along the line XII-XII of FIG. 6.
Figure 13:
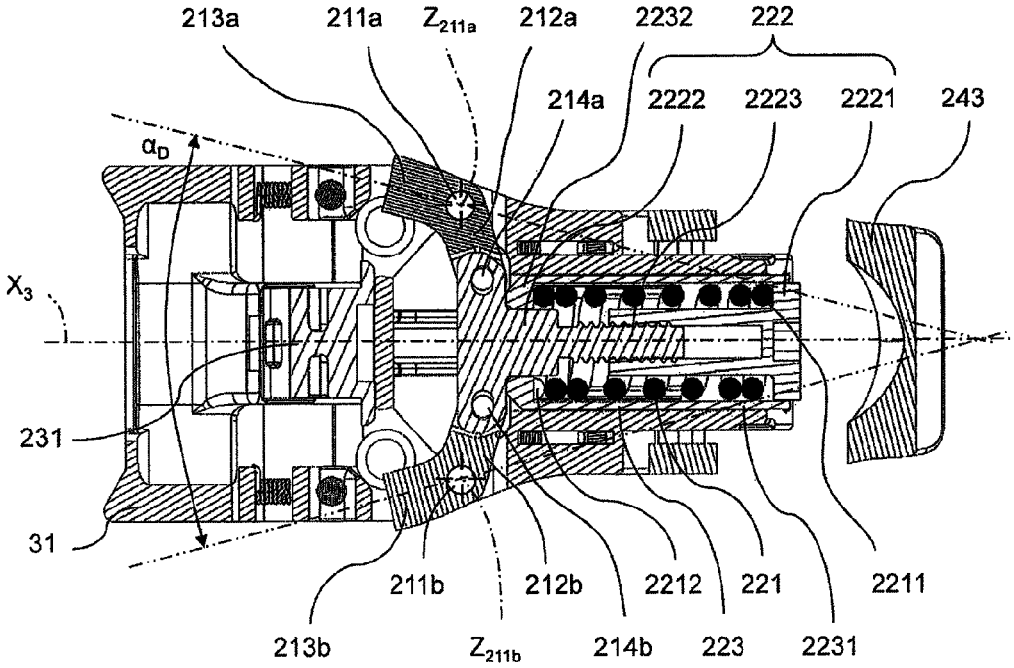
FIG. 13 is a cross-sectional view along the line XIII-XIII of FIG. 12.
Figure 14:
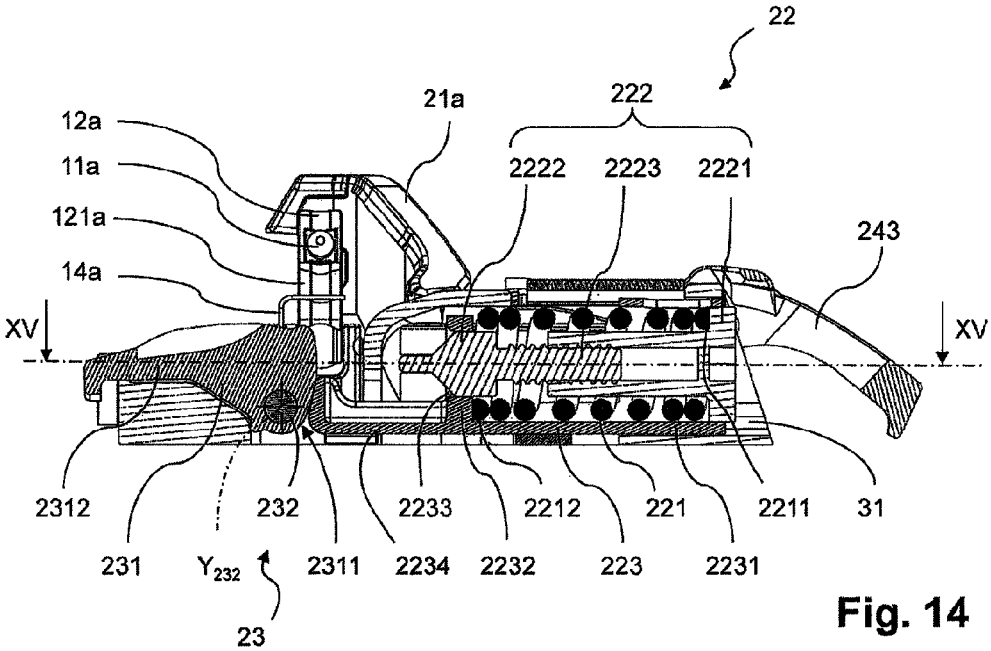
FIG. 14 is a cross-sectional view of the toe-piece alone, along the line XIV-XIV of FIG. 7.
Figure 15:
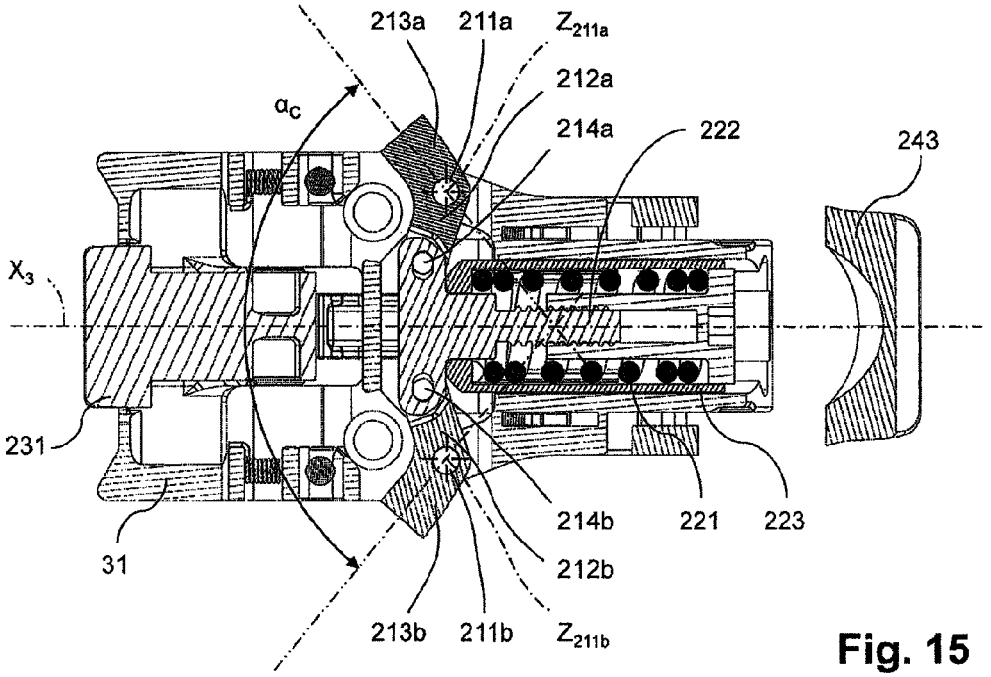
FIG. 15 is a cross-sectional view along the line XV-XV of FIG. 14.
Figure 16:
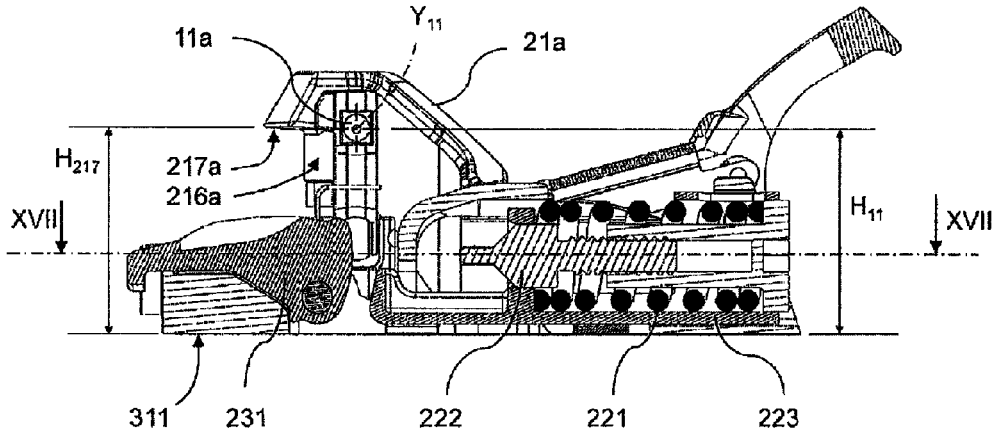
FIG. 16 is a cross-sectional view of the toe-piece alone, along the line XVI-XVI of FIG. 8.
Figure 17:
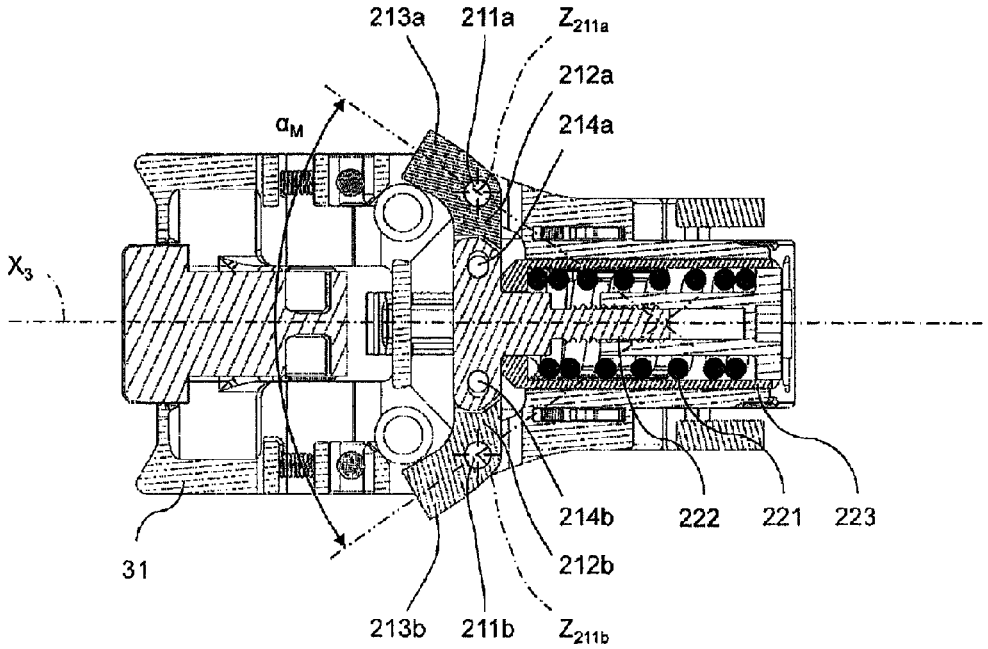
FIG. 17 is a cross-sectional view along the line XVII-XVII of FIG. 16.
Figure 18:
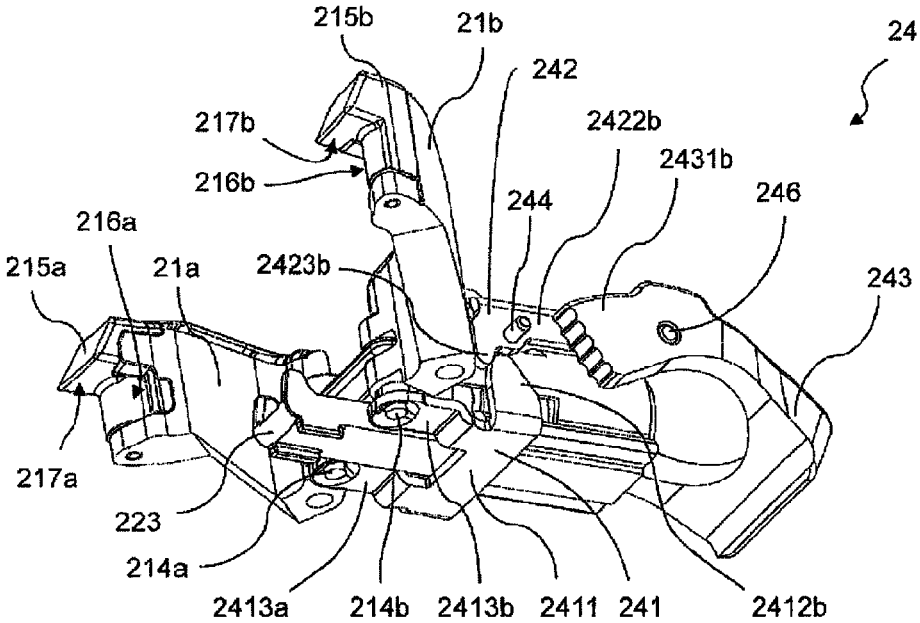
FIG. 18 is a rear perspective view of a toe-piece positioning mechanism, the mechanism being in a first configuration.
Figure 19:
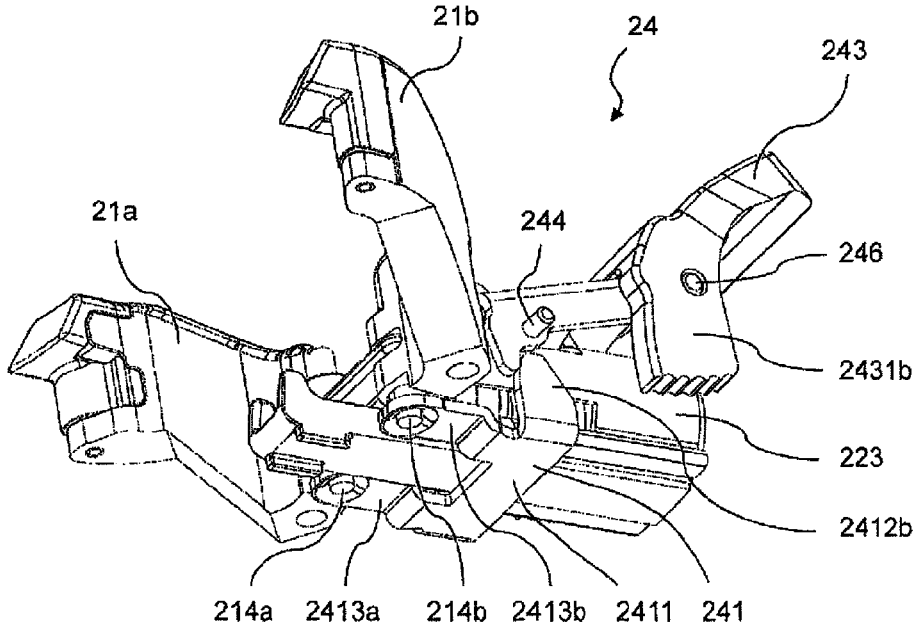
FIG. 19 is a rear perspective view of the mechanism of FIG. 18, the mechanism being in a second configuration.

The ascent configuration of the first front retaining device 10 corresponds to the third configuration of the toe-piece. It is illustrated in FIGS. 2, 4, 5, 8, 11, 16, 17. As shown in FIG. 11, for example, it is characterized by a spacing $W_{11M}$ of the fastening mechanisms 11*a*, 11*b*, such that the latter cooperate continuously with the front portion 52 of the boot. In this case, the end portions of the points are sufficiently close to remain in the recesses 521*a*, 521*b* of the front portion of the boot. To maintain this cooperation, the spacing of the points is limited by reducing the opening of the wings 21*a*, 21*b*. In the embodiment described, it suffices to act on the lever 243 of the positioning mechanism 24 to obtain a predetermined opening angle $\alpha_M$ of the wings. See FIG. 8.

Figure 10:
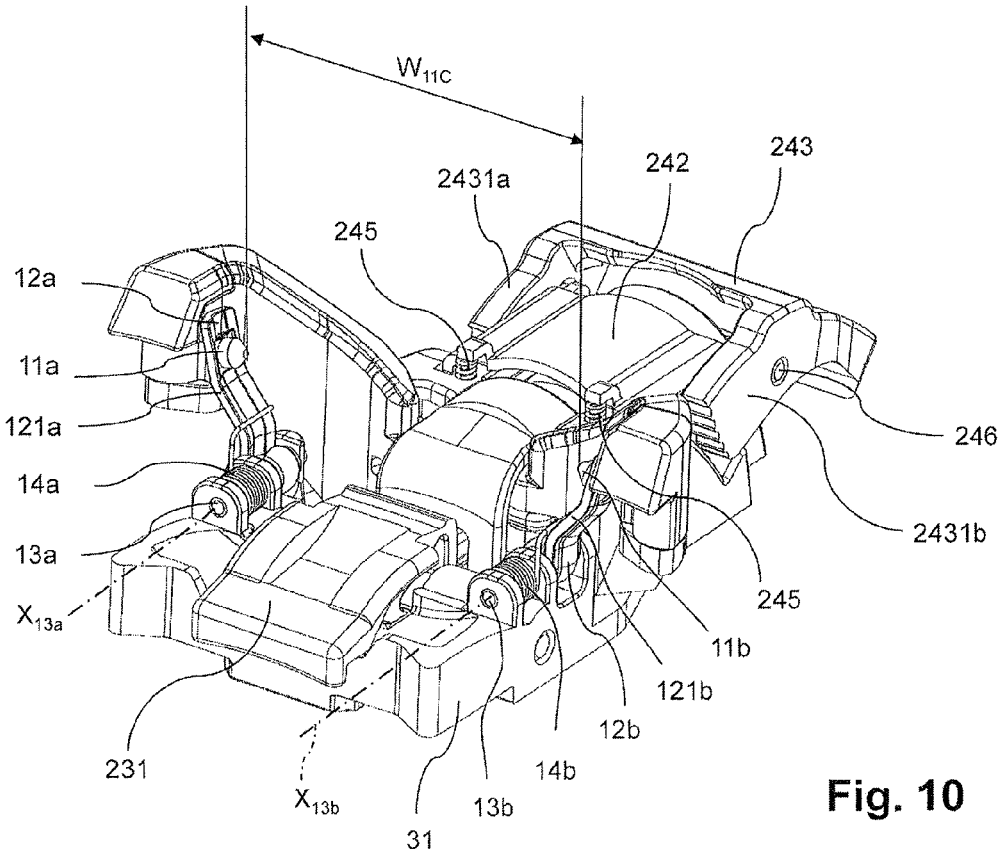
FIG. 10 is a rear perspective view of the toe-piece alone, the toe-piece being in its second, so-called boot-fitting configuration.

The boot-fitting configuration of the first front retaining device 10 corresponds to the second configuration of the toe-piece. It is illustrated in FIGS. 7, 10, 14, 15. As shown in FIG. 10, for example, it is characterized by a spacing $W_{11C}$ of the fastening mechanisms 11*a*, 11*b*, such that the latter can be released from the front portion 52 of the boot. In this configuration, the boot is not retained to the gliding board by the toe-piece. In this example, the spacing of the end portions of the points is greater than the distance between the inlets of recesses 521*a*, 521*b* of the front portion of the boot. This distance corresponds substantially to the width of the front portion of the boot. To obtain this release, a greater spacing of the points is allowed by increasing the opening of the wings 21*a*, 21*b*. For this, in the embodiment described, it suffices to act on the lever 243 of the positioning mechanism 24 to obtain a greater predetermined opening angle $\alpha_C$ of the wings.

According to the embodiment described, the supports 12*a*, 12*b* are dimensioned and arranged in relation to the wings 21*a*, 21*b*, so that when the toe-piece is in its first configuration, that is to say, when the boot is in contact with the lateral interface surfaces 216*a*, 216*b*, the carrying arms 121*a*, 121*b* pivot to be housed between the wings 21*a*, 21*b*, without interfering with the front portion 52 of the boot or with an element of the toe-piece. The supports are also dimensioned and arranged so as not to disturb the movement of the front portion of the boot during a lateral release of the boot. The carrying arms 121*a*, 121*b* are sufficiently advanced in relation to the location of the lateral interface surfaces 216*a*, 216*b* in order not to hinder the positioning of the boot in the second front retaining device 20 or it release. This arrangement provides a compact toe-piece integrating two front retaining devices, one for the ascent and one for the descent. Furthermore, it makes it possible to protect the first front retaining device 10, when the toe-piece is in the descent configuration. Indeed, the members of the first front retaining devices 10 are housed between the wings 21*a*, 21*b*, thereby ensuring protection.

According to the embodiment described, the fastening mechanisms 11*a*, 11*b* are arranged with respect to the wings 21*a*, 21*b* so that the distance $H_{11}$ between the hinge axis $Y_{11}$ and the lower support surface 311 is less than or equal to the distance $H_{217}$ between the vertical interface surfaces 217*a*, 217*b* and the lower support surface 311. This characteristic makes it possible to position the boot close to the gliding surface 42 of the gliding board during ascent phases. However, this proximity substantially improves the stability and performance of the skier when ascending a slope.

According to one example, the arrangement of the fastening mechanisms 11*a*, 11*b* with respect to the vertical interface surfaces 217*a*, 217*b* is such that the difference between the distance $H_{51D}$ between the sole 51 and the lower support surface 311, when the toe-piece is in its first configuration (descent), and the distance $H_{51M}$ between the sole 51 and the lower support surface 311, when the toe-piece is in its third configuration (ascent), is less than ten millimeters.

According to the embodiment described, the fastening mechanisms 11*a*, 11*b* are arranged with respect to the wings 21*a*, 21*b* so that the longitudinal position of the boot, when engaged with the first front retaining device 10, according to the third configuration of the toe-piece (ascent), is offset forwardly of the toe-piece in relation to the longitudinal position of the boot when engaged with the second front retaining device 20, according to the first configuration of the toe-piece (descent). Advantageously, the distance L5 between these two longitudinal positions is greater than eight millimeters. In a particular embodiment, the distance can be greater than twelve millimeters. This characteristic is particularly important because it makes it possible to switch the configuration of the binding from an ascent configuration to a descent configuration, or vice versa, without having to move the heel-piece or the toe-piece. Indeed, with a suitable displacement, the heel of the boot is no longer positioned to cooperate with the fastening mechanism of the heel-piece. This is what is desired when switching to the ascent mode, in which the boot must be pivotable about a transverse axis positioned at the front of the boot. In addition, it enables the boot to move back in relation to the ski during descent phases, which is advantageous when skiing off-piste, especially in powder snow. Under these conditions, it is preferable to ski switch backwards to prevent the shovels from being driven into the snow.

Other first front retaining devices 10 are within the scope of the invention.

According to a first such example, each support of a fastening mechanism can be rotatably mounted about a substantially vertical axis. In an alternative, the supports can pivot about the same axes of rotation as those of the wings. In another alternative, the supports can pivot about the same axes of rotation as those of the connecting pins. A support can thus pivot about a fixed axis in relation to the frame or in relation to a wing.

The previous embodiments describe supports pivoting respectively about an axis of rotation. In an alternative embodiment, the supports are not articulated. The spacing of the fastening mechanisms derives from a deformation of a portion of the support. In this case, a carrying arm pivots about a virtual "axis of rotation" due to the deformation of the arm. The axis of rotation must be extrapolated because it does not actually exist. It is deduced from the deformation of the support.

In the proposed solutions, each fastening mechanism is movable independently of the wings. This construction provides a suitable dimensioning for each front retaining device 10, 20. In particular, this makes it possible to optimize the dimensioning of the first front retaining device 10 provided for the ascent. The latter may be designed not to be subject to substantial biases by springs, as is the case in most front retaining devices provided for the ascent. Because the supports are only slightly constrained, they may be lightened. In addition, it is easier to replace a defective part without simultaneously affecting the two front retaining devices.

In these embodiments, the toe-piece includes a first front retaining device comprising two supports, each support comprising a carrying arm supporting a fastening mechanism. The fastening mechanism can form a portion of the carrying arm. Advantageously, each carrying arm is capable of coming into contact with a take-up element of the toe-piece, the take-up elements being designed to maintain a relative spacing $W_{11M}$ between the fastening mechanisms when the latter cooperate with the front portion of the boot. In this case, the toe-piece comprises two take-up elements, each cooperating with a respective carrying arm. Other alternative embodiments are within the scope of the invention. For example, the take-up element may be a unitary element co-operating simultaneously with the two carrying arms, for example a fork. The take-up element(s) is/are then capable of cooperating with at least one carrying arm of a support so as to limit the spacing of the fastening mechanisms by a predetermined value $W_{11M}$. Thus, the fastening mechanisms cannot be spaced apart beyond the predetermined value, but they can optionally come closer together. The take-up element may be provided to only prevent the spacing, or to prevent the spacing and the coming closer together.

To obtain this limitation of movement of the fastening mechanisms, the take-up element(s) is/are positioned in relation to the supports so as to interfere with the movement of the supports. In other words, the take-up elements form abutments for the supports. The cooperation is direct. In a particular embodiment, a take-up element cooperates with a support in the area of a take-up surface located on the same carrying arm of the support on which the fastening mechanism is fixed and, advantageously, in the vicinity of the fastening mechanism. According to an embodiment, the carrying arm, at its second free end, in its inner portion, supports a fastening mechanism and, on the back, in its outer portion, forms a take-up surface designed to come into contact with the take-up element. Thus, the take-up surface is located in the area of the fastening mechanism.

This construction thus enables a lateral force take-up directly by the take-up elements when the boot is engaged with the first front retaining device. In this case, there is little or no lateral force take-up by the carrying arm. In other words, during the ascent phases, a mechanism makes the fastening mechanisms cooperate with the front portion of the boot. A specific device positions and immobilizes the take-up elements so as to block the relative spacing between the fastening mechanisms. It is thus possible to maintain cooperation between the fastening mechanisms and the front portion of the boot, without the fastening mechanisms exerting forces on the boot. Alternatively, one can provide a slight bias of the fastening mechanisms on the boot, having a force of less than six daN. In the prior art, the fastening mechanisms strongly bias the boot, often with a force greater than ten daN. The lateral holding of the boot, when engaged with the first front retaining device, is provided by a direct take-up with the take-up element of the toe-piece. This solution has the advantage of considerably reducing the wear of the fastening mechanisms and/or of the corresponding inserts of the boot. Furthermore, the dimensioning of the device, and more particularly the dimensioning of the supports, can be adapted. Finally, reducing the forces exerted by the fastening mechanisms on the boot reduces undesirable friction forces that can disrupt the rotation of the boot during the ascent phase.

According to one embodiment, the take-up elements are movable. They can be positioned such that they cooperate with the carrying arms of the supports in order to maintain a relative spacing between the fastening mechanisms, when the latter cooperate with the front portion of the boot. They can also be positioned so that the carrying arms can move in order for the fastening mechanisms to be further spaced apart.

The take-up elements can be a single monolithic element.

The take-up elements can be detachable or integral with the toe-piece.

In the embodiment described, the take-up elements are formed by the wings of the second front retaining device. By bringing the wings closer together, the latter act directly on the carrying arm supporting the fastening mechanisms, thereby causing the fastening mechanisms to come closer together until they cooperate with the boot. Then, blocking the opening angle $\alpha$ of the wings blocks the spacing of the fastening mechanisms. The boot is then engaged with the first front retaining device provided for the ascent, without the fastening mechanisms biasing the boot.

In another alternative embodiment, the fastening mechanisms 11*a*, 11*b* are affixed to the wings 21*a*, 21*b* and arranged so that the distance $H_{11}$ between the hinge axis $Y_{11}$ and the lower support surface 311 of the frame 31 of the toe-piece is less than or equal to the distance $H_{217}$ between the vertical interface surfaces 217*a*, 217*b* and the lower support surface 311. In this case, the first and second front retaining devices share common elements. The support of the fastening mechanisms is the wing itself. Advantageously, the fastening mechanisms 11*a*, 11*b* are offset forward in relation to the longitudinal stop surface.

In the previous embodiments, one wing is movable in relation to the other. This makes it possible to replace one wing without having to replace the other.

According to an alternative embodiment, the two wings pivot about a common axis of rotation. The axes of rotation axes $Z_{211a}$ and $Z_{211b}$ are then merged. This common axis may be substantially vertical.

In addition, the two wings are kinematically connected, so that the rotation of one wing in one direction causes the rotation of the other wing in the other direction. This characteristic makes it possible to open the wings quickly to release the boot.

In the examples described, the fastening mechanisms are points cooperating with recesses arranged on the front portion of the boot, typically on an attached insert. Nevertheless, other embodiments can be considered for the first front retaining device as long as they define a hinge axis $Y_{11}$ about which the boot can pivot. For example, the points can be cylinders, or the front portion can support a shaft connecting to the toe-piece.

As mentioned above, the actuator 231 comprises a support surface designed to come into contact with the sole of the boot. This support surface makes it possible to position the boot so that the vertical position of the inlets of the recesses 521*a*, 521*b* of the front portion of the boot are substantially in the same area as the vertical position of the fastening mechanisms 11*a*, 11*b*. This support surface then provides assistance with boot-fitting by facilitating the engagement of the boot with the first front retaining device 10.

The description discloses a release mechanism, an adjustment mechanism, and a positioning mechanism. The solutions described and illustrated are non-limiting. The invention extends to other solutions for release, adjustment, or positioning mechanisms that are consistent with the claims of the invention.

The invention is not limited to the described and illustrated embodiments. It is possible to combine the embodiments or features of embodiments.

The invention also extends to all embodiments covered by the appended claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A toe-piece for binding a boot onto a gliding board, the toe-piece comprising:

a first front boot-retaining device designed for retaining the boot in a slope-ascending configuration of the toe-piece, said first boot-retaining device comprising boot-fastening mechanisms defining a boot-pivoting hinge axis in the slope-ascending configuration;

a second front boot-retaining device provided for retaining the boot in a slope-descending configuration of the toe-piece, said second boot-retaining device comprising two wings each of the two wings supporting a lateral interface surface designed to come into contact with a front portion of the boot when the toe-piece is in the slope-descending configuration;

a longitudinal stop surface movable between the following positions:

an active position in which the longitudinal stop surface is designed to cooperate with the front portion of the boot; and an inactive position in which the longitudinal stop surface is designed not to be capable of cooperating with the front portion of the boot;

the longitudinal stop surface being movable in relation to the two wings.

2. A toe-piece according to claim 1, wherein:

one of the two wings is movable in relation to another of the two wings.

3. A toe-piece according to claim 1, wherein:

movement of the longitudinal stop surface is a translation or a rotation, or a combination of different movements.

4. A toe-piece according to claim 1, wherein:

the longitudinal stop surface is affixed to a movable support element.

5. A toe-piece according to claim 4, wherein:

the longitudinal stop surface is formed by an element attached to the support element.

6. A toe-piece according to claim 4, wherein:

while the longitudinal stop surface is in the inactive position, the support element is positioned in relation to the first front retaining device such that no portion of the support element is in a position to interfere with the boot when the boot pivots about the hinge axis in the slope-ascending configuration of the toe-piece.

7. A toe-piece according to claim 4, wherein:

the support element is rotatably mounted in relation to a frame of the toe-piece and the support element is positioned in relation to the second front retaining device, such that the support element tilts rearwardly of the toe-piece to be housed between and beneath the two wings, when the longitudinal stop surface is in the inactive position.

8. A toe-piece according to claim 7, wherein:

the support element comprises an abutment surface designed to come into contact with the frame for positioning the longitudinal stop surface in the active position.

9. A toe-piece according to claim 4, wherein:

the support element includes an edge adapted to partially cover the front portion of the boot.

10. A toe-piece according to claim 4, wherein:

the support element comprises a holding mechanism designed to cooperate with an element of the toe-piece to hold the support element in a stable folded position.

11. A toe-piece according to claim 4, wherein:

the support element forms an actuator designed to actuate an adjustment mechanism.

12. A toe-piece according to claim 11, wherein:

the adjustment mechanism is structured and arranged to space apart the two wings of the second front retaining device.

13. A toe-piece according to claim 1, wherein:

the longitudinal stop surface is in the active position when the toe-piece is in the slope-descending configuration.

14. A gliding apparatus comprising:

a gliding board; and a toe-piece comprising:

a first front boot-retaining device designed for retaining the boot in a slope-ascending configuration of the toe-piece, said first boot-retaining device comprising boot-fastening mechanisms defining a boot-pivoting hinge axis in the slope-ascending configuration;

a second front boot-retaining device provided for retaining the boot in a slope-descending configuration of the toe-piece, said second boot-retaining device comprising two wings each of the two wings supporting a lateral interface surface designed to come into contact with a front portion of the boot when the toe-piece is in the slope-descending configuration;

a longitudinal stop surface movable between the following positions:

an active position in which the longitudinal stop surface is designed to cooperate with the front portion of the boot; and an inactive position in which the longitudinal stop surface is designed not to be capable of cooperating with the front portion of the boot;

the longitudinal stop surface being movable in relation to the two wings.

* * * * *